US005086609A

United States Patent [19]

Tetenborg

[11] Patent Number: 5,086,609

[45] Date of Patent: Feb. 11, 1992

[54] METHOD AND AN APPARATUS FOR PRODUCING, FILLING AND SEALING BAGS

[75] Inventor: Konrad Tetenborg, Lergerich, Fed. Rep. of Germany

[73] Assignee: Windmoller & Holscher, Lengerich, Fed. Rep. of Germany

[21] Appl. No.: 647,018

[22] Filed: Jan. 30, 1991

[30] Foreign Application Priority Data

Jan. 30, 1990 [DE] Fed. Rep. of Germany ..... 4002652
May 30, 1990 [DE] Fed. Rep. of Germany ..... 4017452

[51] Int. Cl.[5] ..... B65B 43/04; B65B 9/13; B65B 7/06; B65B 43/26

[52] U.S. Cl. ..... 53/452; 53/459; 53/468; 53/479; 53/570; 53/373.6; 53/373.7

[58] Field of Search ..... 53/459, 469, 479, 547, 53/563, 567, 570, 450, 452, 455, 468, 562, 373.6, 373.7

[56] References Cited

U.S. PATENT DOCUMENTS

| | | | |
|---|---|---|---|
| 3,568,402 | 3/1971 | Lense et al. | 53/570 X |
| 3,607,574 | 9/1971 | Satake | 53/567 X |
| 3,813,847 | 6/1974 | Kühnle | 53/570 X |
| 3,908,335 | 9/1975 | Giannelli | 53/570 X |
| 3,948,019 | 4/1976 | Döring et al. | 53/570 X |
| 4,003,188 | 1/1977 | Lau | 53/570 X |
| 4,108,300 | 8/1978 | Hayase et al. | 53/570 X |
| 4,378,666 | 4/1983 | Onishi | 53/570 |
| 4,423,583 | 1/1984 | Carey | 53/570 X |
| 4,833,867 | 5/1989 | Reichstahler | 53/567 |

*Primary Examiner*—Horace M. Culver

*Attorney, Agent, or Firm*—Fleit, Jacobson, Cohn, Price, Holman & Stern

[57] ABSTRACT

The invention relates to a method for the manufacture, filling and sealing of bags starting with a flat web of tubular foil preferably provided with side folds of thermoplastic synthetic resin in the case of which the respectively leading end of the tubular foil web is provided with a transverse weld seam and then a section in the form of an open bag is severed from the tubular foil web and wherein the bag is then filled and the open end of the bag is drawn taut and closed by means of a transverse weld. In order to achieve the aim of providing a method and an apparatus of the type initially mentioned with which bags may be produced, filled and sealed with a simple mechanical system after the production of the terminal transverse weld the tubular foil web is fed by the length of a section through the opened welding jaws of the welding station and the bag formed in this manner is gripped laterally by a pair of grippers and at a higher level than the pairs of grippers is severed from the tubular foil web using a transverse severing cut. The bag held by the pairs of grippers on the two sides of its open end lower down than the edge of the opening is conveyed by the pair of grippers into the filling station, wherein for opening the bag the grippers are moved towards each other. The pairs of grippers pull taut the edges of the opening of the bag after the same has been filled and return the same into the welding station, in which the ends of the opening of the bag, which project beyond the pair of grippers, are connected together by a head weld. The invention furthermore relates to an apparatus for performing the said method.

19 Claims, 11 Drawing Sheets

METHOD AND AN APPARATUS FOR PRODUCING, FILLING AND SEALING BAGS

The invention relates to a method for the manufacture, filling and sealing of bags starting with a flat web of tubular foil preferably provided with side folds, of thermoplastic synthetic resin in the case of which the respectively leading end of the tubular foil web is provided with a transverse weld seam and then a section in the form of an open bag is severed from the tubular foil web and wherein the bag is then filled and the open end of the bag is drawn taut and closed by means of a transverse weld, and to an apparatus for the performance of the method.

The European Pat. publication 0 290 879 A2 describes a method and an apparatus, with which it is possible to produce, to fill and to seal bags with a high efficiency, because a device for the manufacture of the bags is followed by a filling and sealing device so that the output rate is substantially only dependent on the times necessary for filling the individual bags, because the head welds with which the filled bags are sealed, are produced during conveying of the bags out of the filling station. Owing to it high inherent efficiency this known device is comparatively elaborate so that its high purchase price is only justified if it is able to be operated generally with the use of all its production capabilities.

Accordingly one object of the present invention is to provide a method and an apparatus of the type initially mentioned with which bags may be produced, filled and sealed with a simple mechanical system.

In the case of a method of the type initially mentioned this object is to be attained in accordance with the invention since after the production of the terminal transverse weld the tubular foil web is fed by the length of a section through the opened welding jaws of the welding station and the bag formed in this manner is gripped by pairs of lateral grippers and at a higher level than the pairs of grippers is severed from the tubular foil web using a transverse severing cut, the bag held by the pairs of grippers on the two sides of its open end lower down than the edge of the opening is conveyed by the pairs of grippers into the filling station, wherein for opening the bag the grippers are moved towards each other and the pairs of grippers pull taut the edges of the opening of the bag after the same has been filled and return the same into he welding station, in which the edges of the opening of the bag, which project beyond the pair of grippers, are connected together by a head weld. Accordingly the method in accordance with the invention may be performed with little apparatus complexity, because both for forming the bottom welds and also forming the head welds it is only necessary to have a single welding station. This simplified manner of operation is due to the fact that after the formation of the bottom weld the section forming the bag, which is to be filled, is fed back through the opened welding jaws prior to its severance from the tubular foil web so that it is gripped at the edge of its opening by the pairs of grippers and is moved by the same into the filling station and then for the production of the head sealing weld is moved back into the welding station so that it is not necessary to provide any separate welding station for the production of the bottom welds for the manufacture of the bags and for the production of the head sealing welds after the filling of the bags.

The pair of grippers may be moved in translation with the bags held by them between the welding station and the filling station, it then however being necessary for the filled bags to be returned upright to the welding station. It is more advantageous to rock the bag after filling from its upright filling position into an oblique position, in which it is then provided with the head weld sealing it. In this method the pair of grippers performs a corresponding rocking movement.

It is an advantage, more particularly, that when in its oblique position, in which it is supported on a supporting means, the sealed bag is so released that it slides onto a conveying device for removing it. The filled bag may therefore be released from the welding station after the production of the weld at the head end in such a manner that the bag completely leaves the welding and filling station so that the station is free for the production and filling of the next bag.

An apparatus for performing the method in accordance with the invention and comprising a pair of grippers gripping the bags in the vicinity of their opening at the lateral zones, such pair of grippers consisting of cooperating jaws and adapted to be moved towards and away from each other, a filling spout and a welding device which uses transverse welds to seal the edges, which are drawn taut by moving the grippers away from each other in such a manner that they rest on each other, of the filled bags, is characterized in accordance with the invention that the pair of grippers is adapted to be moved between a welding station provided with the welding device and the filling spout in a filling station. In the filling station the grippers of the pair of grippers are moved towards each other in such a manner that the edges of the opening of the bag held by the pair of grippers may be pulled apart, for instance by means of suckers. Then it is possible for a vertically moving filling spout of the filling station to be inserted into the bag opened up in this manner.

In order in accordance with a particularly advantageous working embodiment of the invention to be able produce the bottom and head welds in one welding device, the same is able to be moved between two positions in which on the one hand it produces the bottom weld and on the other hand the head weld for sealing the bag. This movable arrangement of the welding device takes into account the fact that the head weld closing the filled bag has to be produced at a lower position than the bottom weld, which has previously been produced. In this case it is particularly advantageous that the welding device is bearinged in a rocking manner in the machine frame and is provided with a drive, which rocks the same between the two positions.

In accordance with a further feature of the invention the bag is supported on a support device which is pivotally mounted in the machine frame, and by which the bag may be rocked out of its vertical position for filling into an oblique position in which the drawn taut edges of the opening may be provided with the head weld in the welding station. The supporting device may consist of lateral sheet metal supports or a lateral support grid and of arms which are able to be rocked in relation to the same and which support bottom of the bag. The support arms may extend through longitudinally extending gaps between the rail-like sheet metal supports or rods of the grid and be able to be moved in the longitudinal direction of the bags in order to provide for adjustment to different bag lengths.

As part of a further advantageous form of the invention the pair of grippers and the support device are mounted in one frame, which while the pair of transverse welding jaws of the welding device is stationary, may be raised in order to produce the head weld and then lowered again. The frame bearing the pair of grippers and the support device then may in this manner be simply be lifted and lowered if it is borne on a shaft, which is able to be rocked via rocking levers. The levers rocking the frame may be in the form of bell cranks and it is possible for a piston and cylinder unit to be connected with the second lever arm for rocking the frame. The piston and cylinder unit provided for the purpose of moving the bags between the welding and the filling stations may with the frame form a quadrilateral link system so that simple pivoting essentially in height and furthermore between the welding and the filling stations is possible. Since the same welding device initially produces the bottom weld and then, after rocking and filling of the bag, produces the head weld on the intermittently fed tubular foil web and, respectively, on the bag, a suitable control system is provided for the pair of feed rolls during the production of the head weld on the filled bag so that the rolls move the tubular foil web back a short distance and the bottom weld is temporarily moved clear of the transverse welding device.

In keeping with yet another possible form of the invention it is possible for the welding device to be designed as a stationary means if it is provided with two transverse welding devices with an offset in height and of which the upper one produces the bottom welds and the lower ones produces the head welds. It is convenient if a severing knife is connected with one welding jaw of the upper transverse welding device in such a manner that when a bottom weld is produced the knife separates the preceding tubular foil section, which has already been provided with a bottom weld, from the tubular foil web. The two transverse welding devices are provided with a special control device so that they re able to be operated alternatively and separately.

It is convenient if the support arms are provided with a jogging drive, which ensures a dense filling of the bags in the filling station. THe drive for the jogging action may be identical with the rocking drive for the support arms, such drive preferably consisting of a piston and cylinder unit, which on the one hand is acted upon by pressure fluid with a vibrating effect and on the other hand serves as a rocking or pivoting drive.

In accordance with a further ad vantageous feature of the invention the supporting arms together with their pivoting and jogging drive are borne in a carrying frame, which is able to be moved in relation to the sheet metal support or the rods of the grid. In order to move the carrying frame it is possible to provide a drive screw. If however the supporting arms are to be moved upwards in steps for producing the head welds in the filled bags, there is preferably a piston and cylinder unit as a drive.

As part of a further advantageous feature of the present invention the pair of grippers and the support device are arranged in a frame, which is pivotally mounted in the machine frame and is provided with a pivoting drive. The pair of grippers are in addition provided with drive devices for opening and shutting their gripping jaws and for causing motion thereof towards and away from each other.

Further it is possible to provide an intermittently driven pair of feed rolls in the machine frame, which draw forwards the tubular foil web by one section length at a time. In this respect it is possible for the tubular foil web to be drawn off a supply roll.

As part of a further advantageous form of the invention a pair of gripping jaws is provided in the machine frame between the pair of feed rolls and the welding device, which grips the front end of the tubular foil web, when a bag section is severed off by a transverse cut from the same.

Furthermore it is possible for each pair of welding ajws to be secured to a lever, which is bearinged by means of pairs of parallel links on the frame. The lever than forms a pitman, which by means of an articulated quadrilateral system is able to be rocked in such a manner as to be substantially parallel to itself.

A further possible feature of the invention is such that a lever bearing a welding jaw is provided with a groove, or a cooperating knife, for a cutting knife, which is mounted on the pivoting frame. The transverse cutting knife then performs a transverse cut in the vicinity of the welding bar in such a manner as to separate a bag.

In accordance with the invention the head and bottom welds of the bag are produced essentially in one position when the bag is produced and after is has been filled so that it is only necessary to provide a single welding station. The bags produced but so far not filled are taken up by a gripping device, from which they are only released after filling and the production of the head welds for closing them. Accordingly high quality closing welds may be produced.

The welding device is located over the gripper device so that one and the same welding device may be used for both the bottom welds and also for the head welds.

Working embodiments of the invention will now be described with reference to the drawing in more detail.

Figure 1:
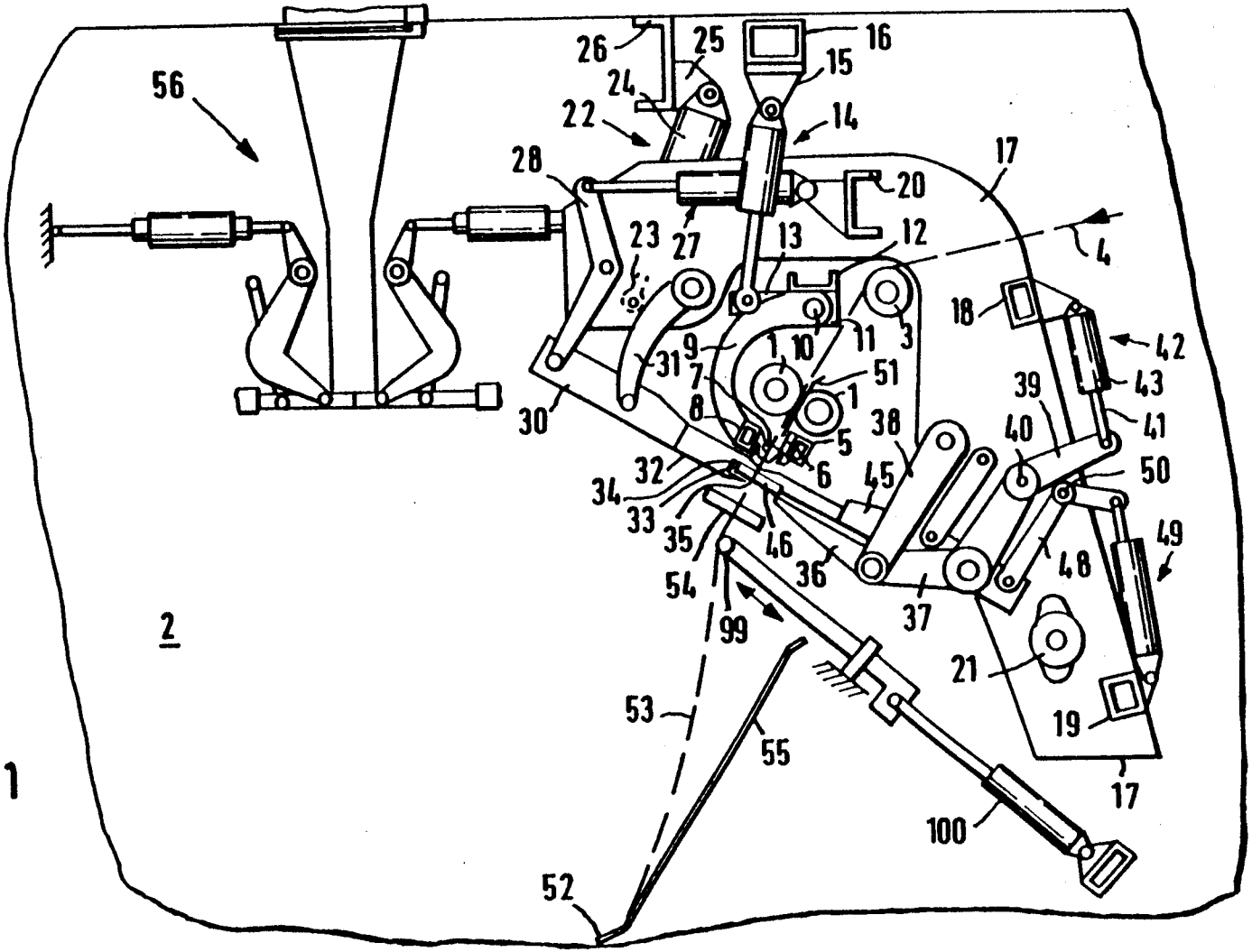
FIG. 1 is a diagrammatic side elevation of an apparatus for the production, filling and closing of bags with the front wall of the frame raised after feeding tubular foil web having a bottom weld through the welding jaws and after gripping the upper edge part of the separated bag.

In the case of the apparatus illustrated in the figure a pair of feed rolls 1 is bearinged in the lateral frame walls of a machine frame, of which the back wall 2 is shown. By means of this pair 1 of feed rolls it is possible for the tubular foil web 4 to be fed forwards, which is guided over the bend roll 3. A short distance past the pair 1 of feed rolls in the direction of conveying there is a crosspiece 5, which is borne in the frame side walls and carries a gripping jaw 6. The opposite jaw 7 associated with this haw 6 is for its part mounted on a crosspiece 8, which is mounted by means of its two end parts on the arms 9. The latter are mounted fixedly on a shaft 10, which is bearinged in brackets 11. The brackets are fixedly connected with a transverse beam 12. In order to be able to pivot the arms 9 a lever 13 is mounted on the shaft 10 and this lever 13 is acted upon by a respective piston and cylinder unit 14, whose cylinders are connected via a bracket 15 with a girder 16 connecting the two side frame walls. All parts mentioned so far are mounted in the side frame walls.

Furthermore a generally C-like plate 17 is associated with each side frame wall 2, such plates 17 being connected together via the box girders 18 and 19 and via the U-girder 20. The C-like plates 17 connected together in this manner are bearinged on a shaft 21, which for its part is fixedly connected with the side frame wall 2. In order to be able to pivot the two C-like plates 17 about this shaft 21, there is piston and cylinder unit 22, whose piston rod 23 is connected with the head part of one of the C-like plates and whose cylinder 24 is connected with a bracket 25. This bracket 25 is welded to a U-girder 26, whose end faces are fixedly connected with one respective side frame wall 2.

In the head part of the C-like plates 17 a piston and cylinder unit 27 is pivotally connected with each of the plates, the piston rod of each piston and cylinder unit 27 being in engagement with one end of a bell crank 28. The end of the bell crank 28 remote from the piston rod of the piston and cylinder unit articulates with a lever 30, which is furthermore connected via an arm 31 in an articulating manner with the head part of the C-like plate 17. A transverse girder 32 is welded to the two levers 30, of which only one is shown in FIG. 1 and the front end of the girder 32 has a recess 33 and a welding jaw 34. In the position illustrated in FIG. 1 a knife 35 fits into this recess 3 and may be seen to be mounted on a transverse girder 36. This transverse girder 36 is held at its end parts by a respective arm 37, each arm being borne by levers 38 and 39. The lever 38 is in this respect pivotally connected with the C-like plate 17. The other arm 39 is in the form of a bell crank, which is pivotally mounted at its apex 40 on the c-like plate 17 and has its one end connected pivotally with the arm 37 and the other end with the piston rod 41 of a piston and cylinder unit 42. The cylinder 43 of this piston and cylinder unit 42 is connected via a bracket 44 with the box girder 18. The transverse girder 45 is also bearinged just like the transverse girder 32 for the welding jaw 3,4 the lever 48 being in the form of a bell crank, which is able to be pivoted by a piston and cylinder unit 49 about its apex 50.

Figure 2:
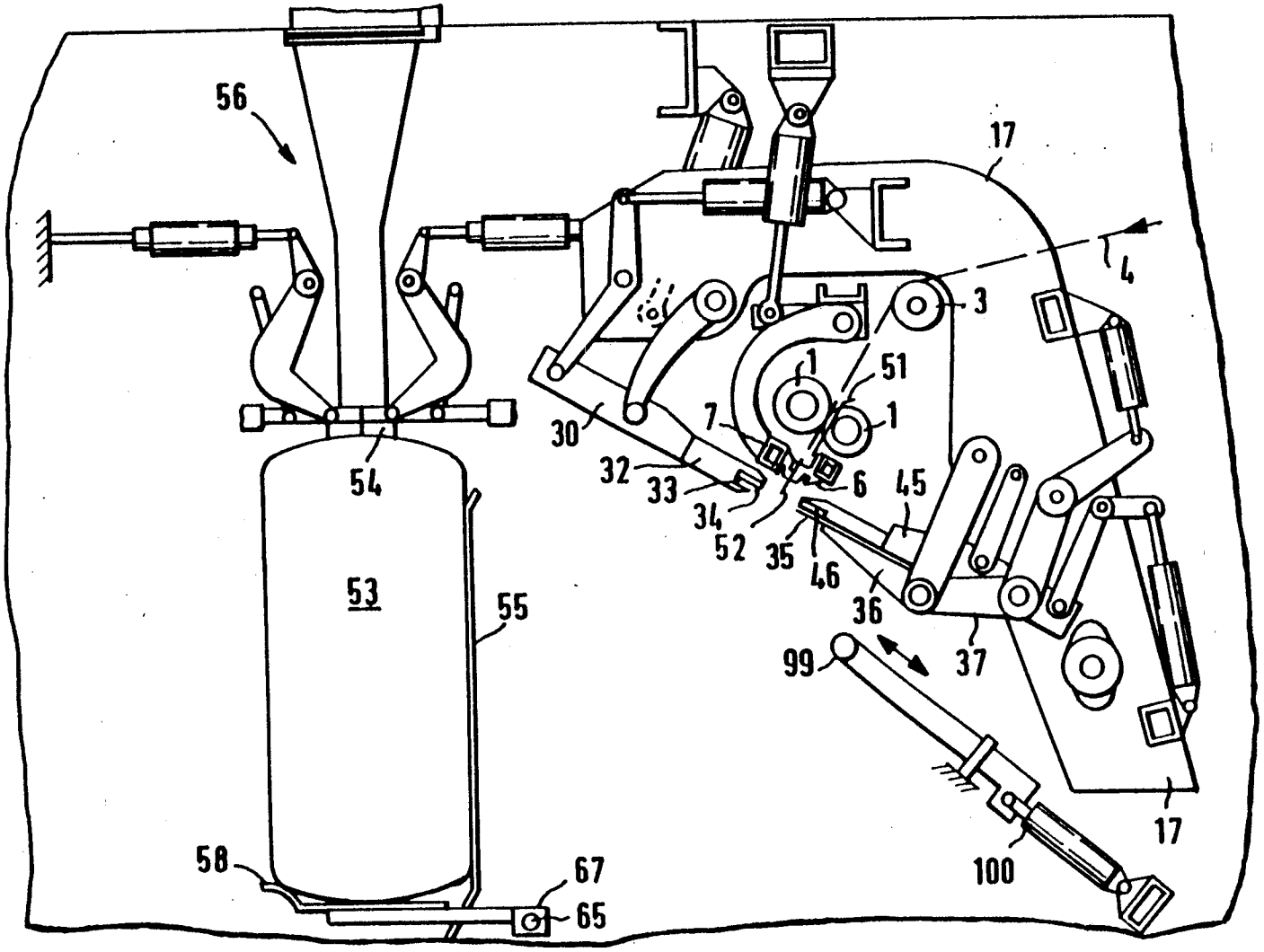
FIG. 2 is a representation, corresponding to that of FIG. 1, of the device with the filled bag in the filling structure.
Figure 3:
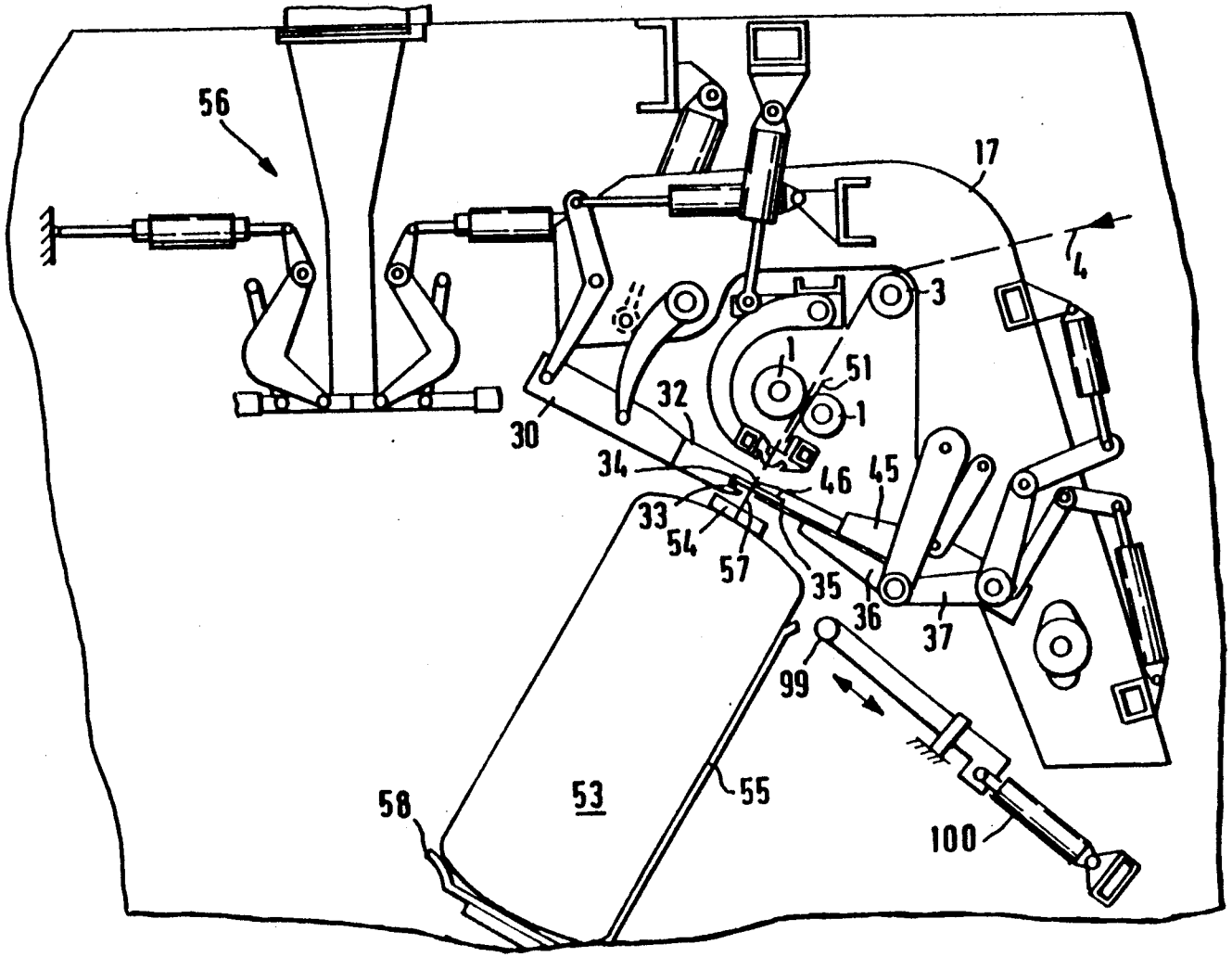
FIG. 3 is a side elevation on a larger scale showing the device in accordance with FIG. 1 in a position, in which the filled bag has been swung back so that its superposed edges of the opening are in the welding station for the application of the head weld.

The right hand half of FIG. 2 shows that the tubular foil web 4 has its front part gripped by the gripping jaws 6 and 7, which have been previously opened so that the tubular foil web 4 was able to be fed forwards by the feed rolls 1 while guided by the rake 51. The piece of tubular foil web projecting past the jaws 6 and 7 is then provided with a bottom seal by the welding jaws, following which the welding jaws swing back and the jaw 7 is opened. The tubular foil web 4 is the advanced so far that its bottom weld or seam 52 assumes the lower position illustrated in FIG. 1. In order to produce a satisfactory guiding action for the freely fed end of the tubular foil web 4 there is a guide roll 99, which is arranged transversely at the front end of a longitudinally sliding carrier guided in the machine frame, such carrier being able to be reciprocated by a piston and cylinder unit 100 in the direction of the double arrow. After the front section of the tubular foil web 4 has reached the position illustrated in figure both the jaw 7 and also the welding jaws 34 and 46 and furthermore the knife 35 are moved into the position illustrated in FIG. 1 to cut the bag 53 from web 4 and also to form the bottom seal in the next bag. The bag 53 so formed and having the bottom weld 52 has its upper part held by lateral pairs 54 of grippers and by pivoting of these lateral gripping jaws and the sheet metal support 55 it is rocked into a position under the filling spout 56, in which position it is connected with the filling spout and is filled. The filling operation is illustrated by FIG. 2 After filling the full bag 53 is swung back by a pivoting device into the position of FIG. 3, which device includes the sheet metal supports 55 as well, and which in the following will be described in more detail. As soon as the bag has reached position illustrated in FIG. 3, the two C-like plates, which are connected together, are swung by the piston and cylinder unit 22 in a counterclockwise direction a small amount in such a manner that the two welding jaws 34 and 46 are lowered somewhat from the FIG. 1 position to form a transverse weld in the head part 57, which extends upwards from the lateral gripping jaws 54 and form an upper seal for bag 53. Then the welding tongs 34 and 46 and also the later pairs 54 of gripping jaws open so that the filled bag 53 is able to be slid along an intermediate sheet metal element 59 onto a conveyor belt 60 arranged thereunder after pivoting clear the jogging sheet metal parts 58. The plant will then be in the starting position illustrated in the right hand half of FIG. 2, there then being no bag in the filling station. The process can then be repeated for the next bag by feeding it to the position shown in FIG. 1.

Figure 4:
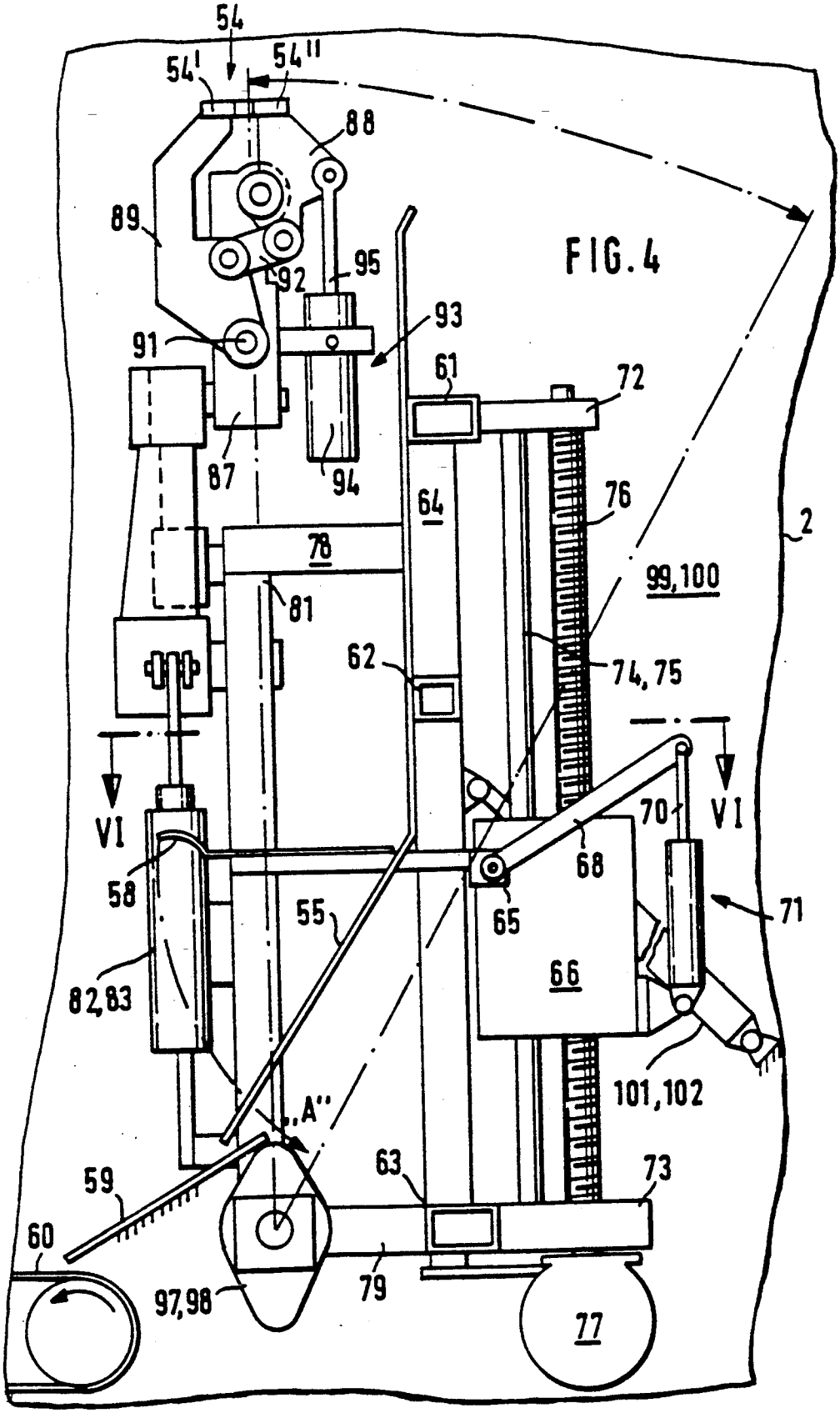
FIG. 4 is a lateral elevation on a larger scale of the device supporting the bag and able to pivot, together with the pair of grippers holding the edges of the openings of the bags.
Figure 5:
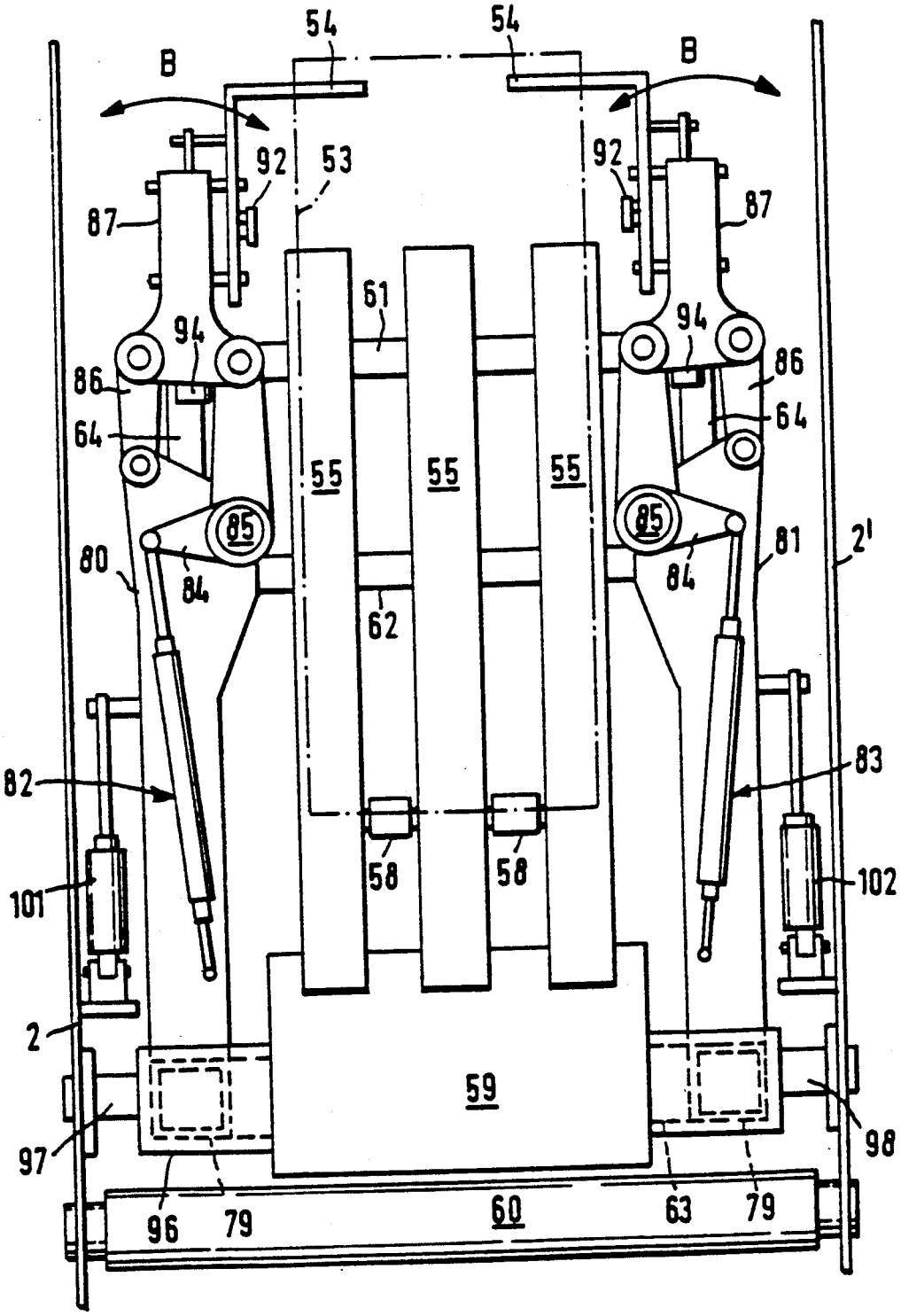
FIG. 5 is a plan view of the device in accordance with FIG. 4.
Figure 6:
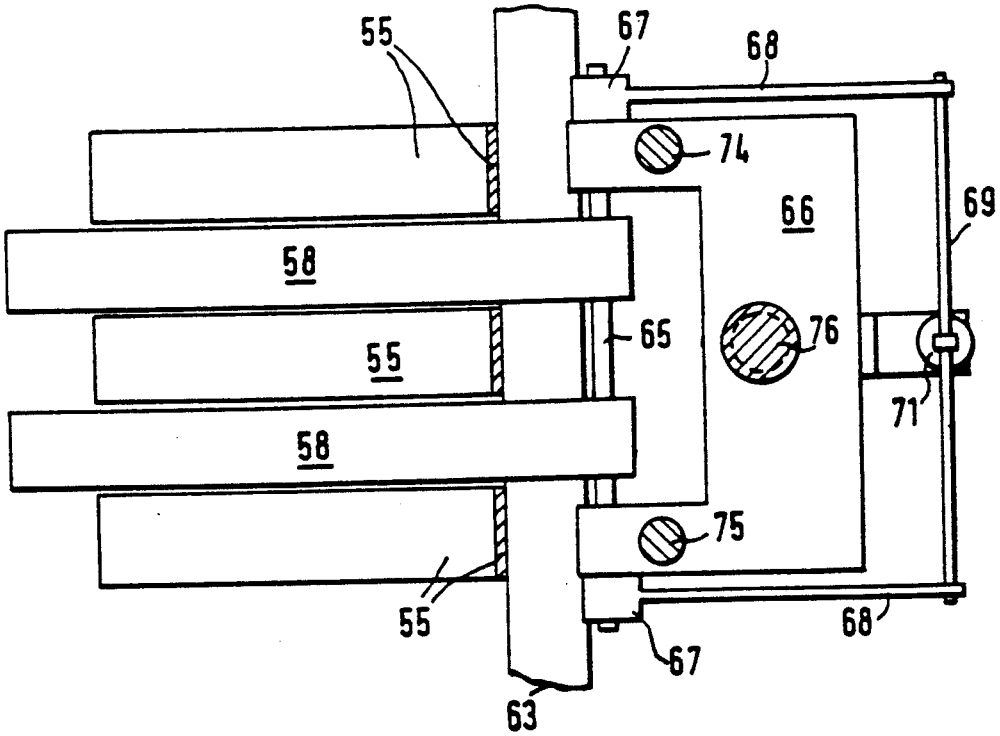
FIG. 6 is a section taken through the device on the line VI—VI of FIG. 4.

The pivoting device, by which a bag 53 may be reciprocated, between the welding station and the filling station is illustrated in FIG. 4 through 6 in more detail and will now be explained in the following. Three transversely running box girders 61, 62 and 63 are connected with each other at their end parts by a respective vertical girder 64. The sheet metal supports 55 already shown in FIGS. 1 and 3 ar secured to the two upper box girders 61 and 62. The sheet metal jogging elements 58 extend through the spaces between the sheet metal supports 55 outwardly to the left (see FIG. 4), the jogging sheet metal elements 58 having their rear part fixedly mounted on a shaft 65. This shaft 65 is rotatably bearinged in a frame 66. The two shaft ends 65 extend to the outside from the frame 66, a bearing support 67 being fixedly mounted on these two shaft ends which have a respective arm 68. The arms 68 are connected with each other by means of a rod 69, with which the piston rod 70 of a piston and cylinder unit 71 is in engagement. Using the piston and cylinder unit 71 it is possible to rock the sheet metal jogging elements 58 out of the position illustrated in FIG. 4 in the counter-clockwise direction (arrowed direction A) so far that they are behind the sheet metal supports 55 and a bag 53 which has been filled in the meantime, is able to slide down onto the conveyor belt 60. The piston and cylinder unit 71 however not only serves to hold the bag during the filling operation but also to jog the bag and thus to compact the filling therein.

In order to make possible adjustment of the vertical position of the sheet metal jogging elements 58 in line with the bag size, the frame 66 (see FIG. 6) is vertically adjustable. For this purpose the box girders 61 and 62 are connected with frame parts 72 and 73, by which two guide rods 74 and 75 and furthermore a drive screw 76 are held. Between the two frame parts 72 and 73 the frame 66 is positioned, which is guided by the two guide rods 74 and 75 and is able to be moved vertically by the drive screw 76. For this purpose the frame 66 has lead nuts connected with it in a manner which is not illustrated for a driving connection with the screw 76. The latter is able to be driven by a motor 77 mounted on the frame 73.

As shown in FIG. 4 the two vertical girders 64 have girders 78 and 79 connected with them which project to the front, that is to say to the left, and which bear frame parts 80 and 81 A piston and cylinder unit 82 and, respectively, 83 is connected pivotally with each frame part 80 and, respectively, 83, the piston rod of each one piston and cylinder unit being in engagement with the end of a bell crank 84. The bell cranks 84 are pivotally connected at their apices 85 with the frame parts 80 and, respectively, 81. These bell cranks 84 and further links 86 bear bearing supports 87, which owing to the way in which they are supported may be rocked backwards and forwards in the direction as indicated by the arrow B (see FIG. 5) and thus they may be moved towards each other over the lateral pairs 54 of gripping jaws of a bag 53 so that the filling spout (see FIGS. 1 through 3) may be moved into bag as opened in this manner. After outward movement of the filling spout 56 has taken place the two pairs 54 of gripping jaws the move apart so that the upper part of the bag is drawn taut and is thus closed.

As shown in FIG. 4 each pair 54 of gripping jaws 54 consists of two gripping jaws 54' and 54'', each gripping jaw being secured to a pivoting lever 88 and, respectively, 89. In this respect the pivoting lever 88 is pivotally connected with the bearing support 87 at its pivot axis at point 90 and the pivoting lever 89 is connected with the bearing support 87 for pivoting about the axis at point 91. The pivoting levers 88 and 89 are so connected with each other by means of a link 92 or pitman that the pivoting movement of the lever 88 is transmitted to the lever 89. In order to pivot, that is to say in order to open and shut a pair 54 of gripping jaws, there is a piston and cylinder unit 93, whose cylinder 94 is pivotally connected with the bearing support and whose piston rod 95 is pivotally connected with the pivoting lever 88.

In order to make it possible for the apparatus described so far to be pivoted, the two lower projecting girders 79 are connected, in the part remote from the box girder 63, with each other by means of a square tube 96, which has end pins 97 and 98. These pins 97 and 98 are rotatably bearinged in the two side walls 2. Therefore by means of the two piston and cylinder units 101 and 102, which at one end are secured to the side walls 2 and at the other to the frame parts 80 and 81, it is possible to pivot the entire assembly as shown in FIGS. 4 through 6.

Figure 7:
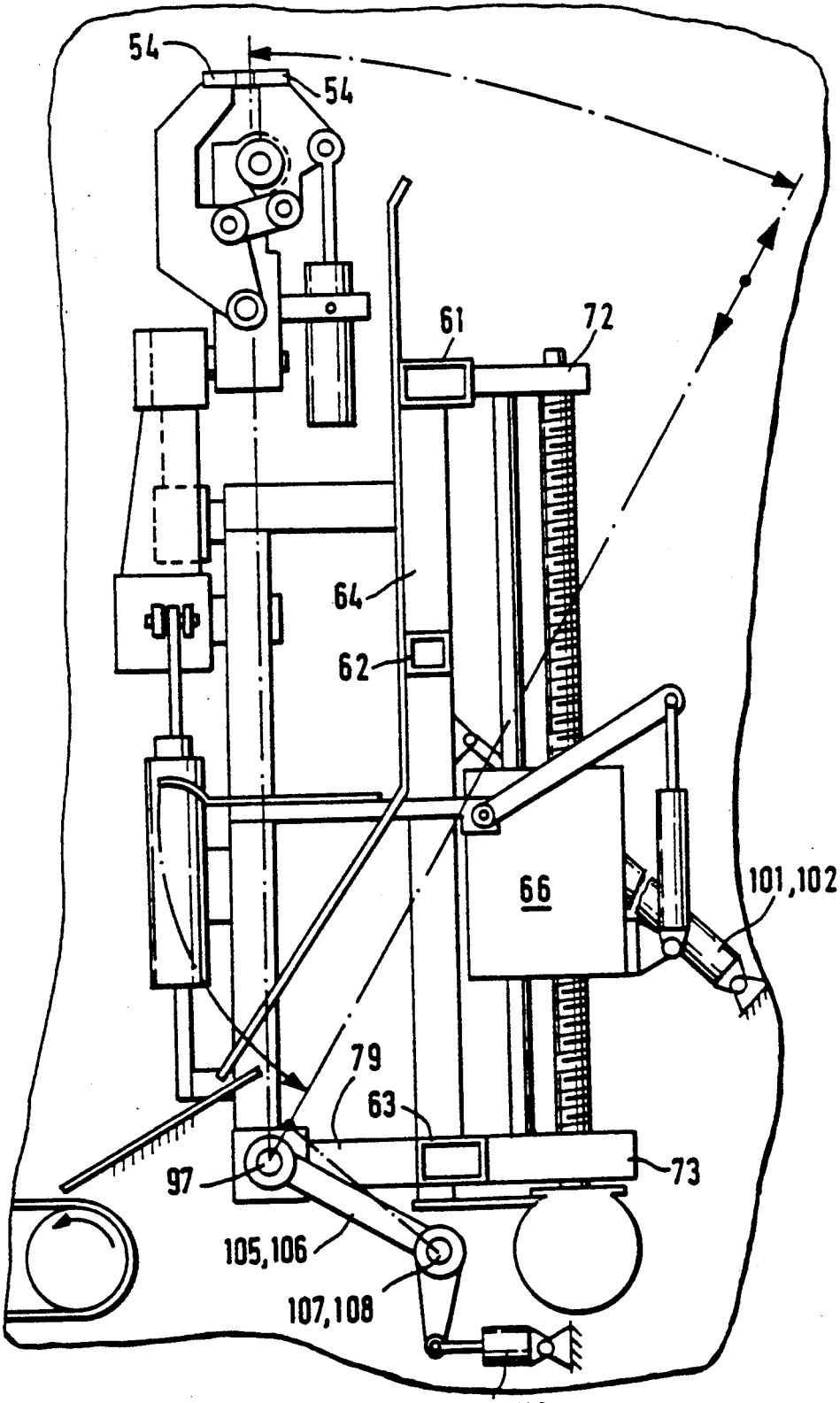
FIG. 7 is a representation corresponding to FIG. 4 of a modified working embodiment of the device in which the frame carrying the pair of grippers and the support device is able to be rocked vertically as well so that it is possible to dispense with a moving transverse welding device.
Figure 8:
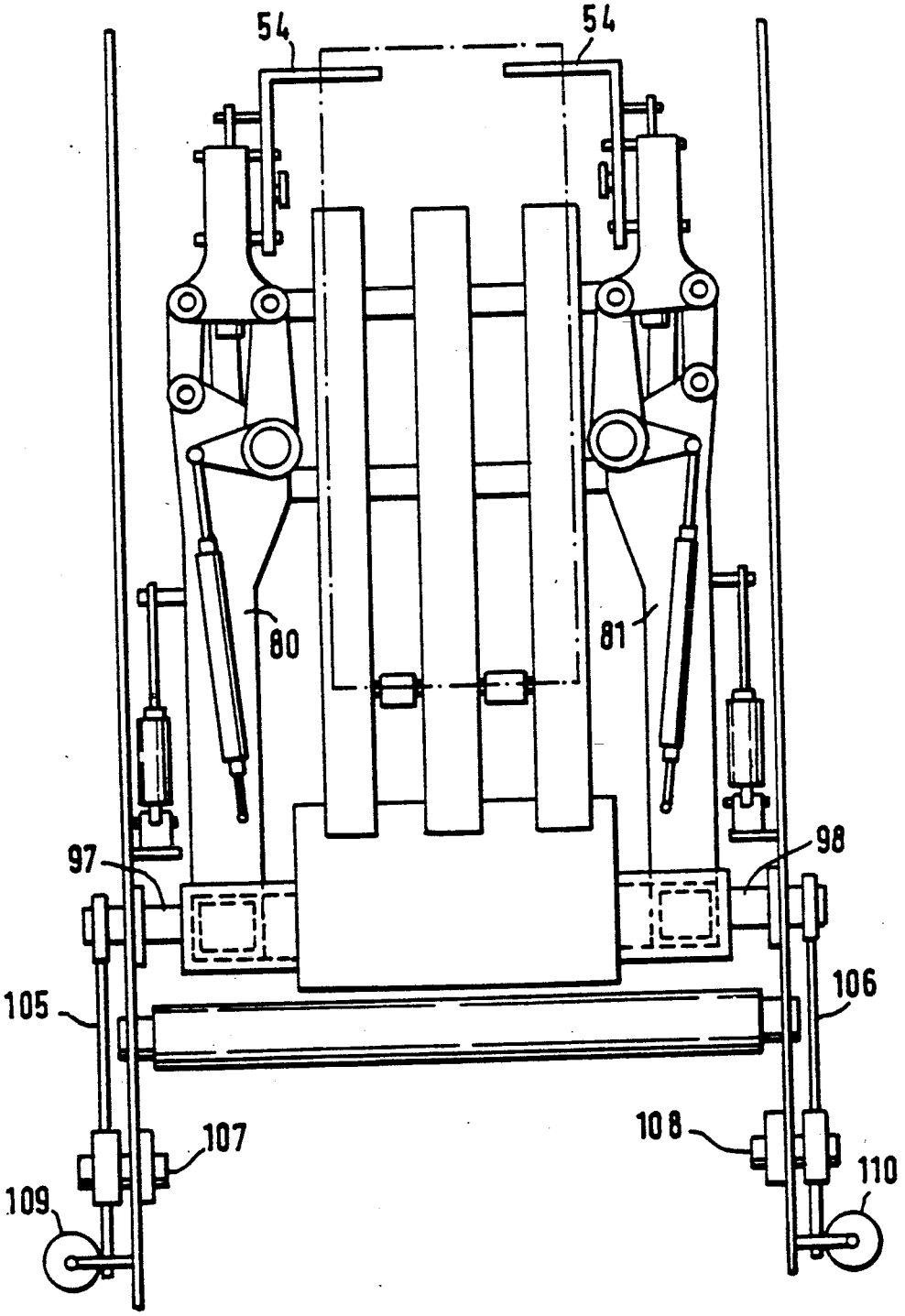
FIG. 8 is a view corresponding to FIG. 5 of the modified device in accordance with FIG. 7.

In the illustrated working embodiment of FIGS. 7 and 8 the frame 61, 62, 63, 64, 79, 80 and 81 bearing the pair 54 of grippers and the support device 55 and 58 is pivotally mounted on the levers 105 and 106 by means of the support pins 97 and 98, which form a sort of pivot shaft, the levers for their part being pivotally carried on the pins 107 and 108 secured to the frame. The levers 105 and 106 are in the form of bell cranks, the free ends of the further lever arms being pivotally connected with the piston rods of the piston and cylinder units 109 and 110, which are 5 pivotally mounted in the frame.

The frame 61, 62, 63, 64, 79, 80 and 81 is in addition held in the frame by the piston and cylinder units 101 and 102, which rock the latter about the support pins 97 and 98 between the welding station and the filling station. Therefore together with the pivot points of the levers 105 and 106 and of the piston and cylinder units 101 and 102 the frame constitutes an articulated quadrilateral system so that by means of the piston and cylinder units 109 and 110 on the one hand and 101 and 102 on the other hand it may be pivoted vertically and also laterally. Since the frame may be seen from FIGS. 7 and 8 to rocked essentially in the vertical direction by means of the piston and cylinder unit 109 and 110, for the production of the bottom welds and of the head welds it is possible to dispense with a pivoting motion of the welding device. For in order to produce the bottom and head welds at different levels it is now possible to rock the frame bearing the bags vertically. But however in order to use the apparatus in accordance with FIGS. 7 and s to produce the head weld after the pivoting of the frame back from the filling station into the welding station it is necessary to draw back the end of the tubular foil web forming the bottom of the next bag clear of the welding device somewhat.

Figure 9:
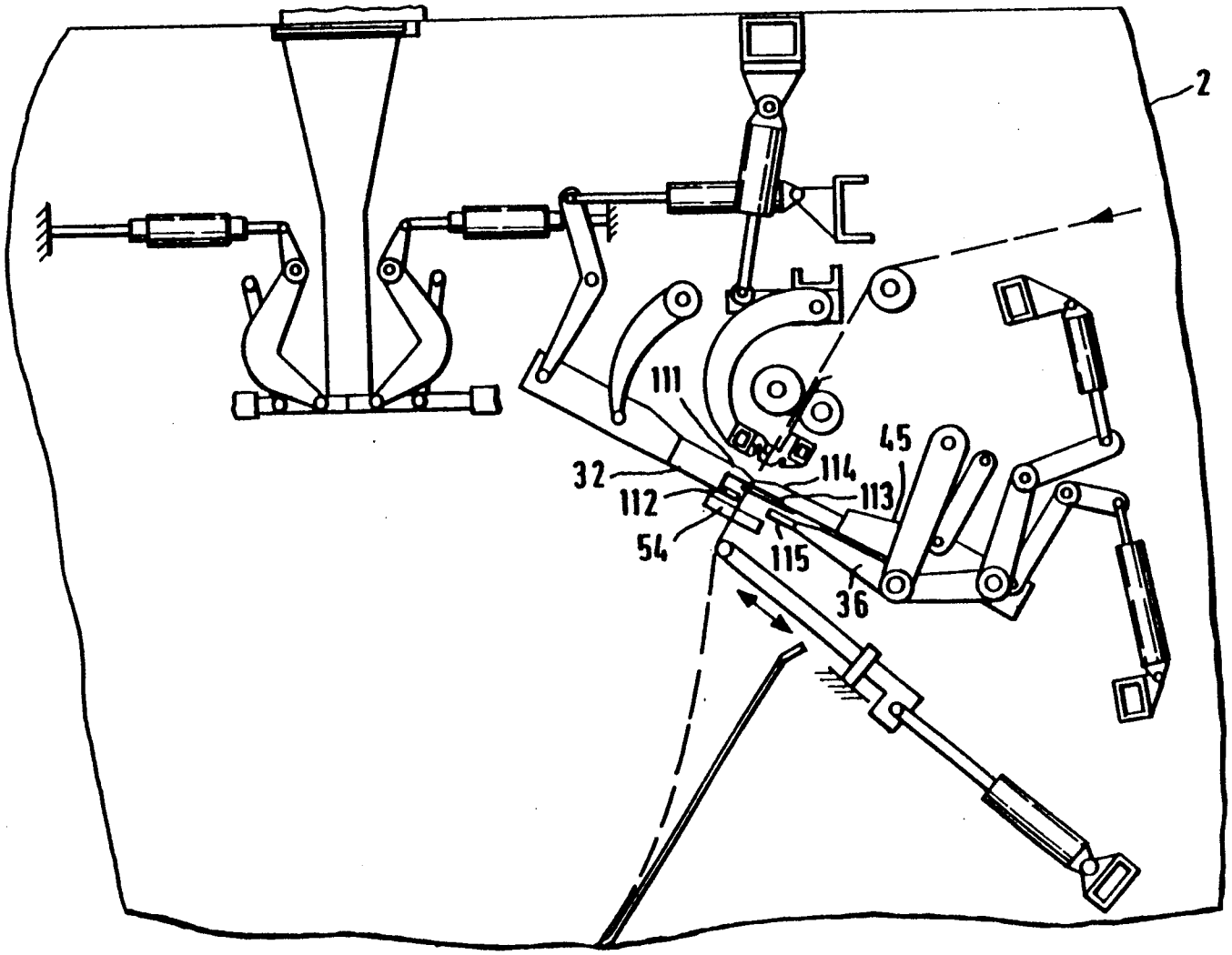
FIG. 9 shows a modified working embodiment corresponding to FIG. 1 in which however the transverse welding device is arranged stationarily and there are two transverse welding device which parallel to each other.
Figure 10:
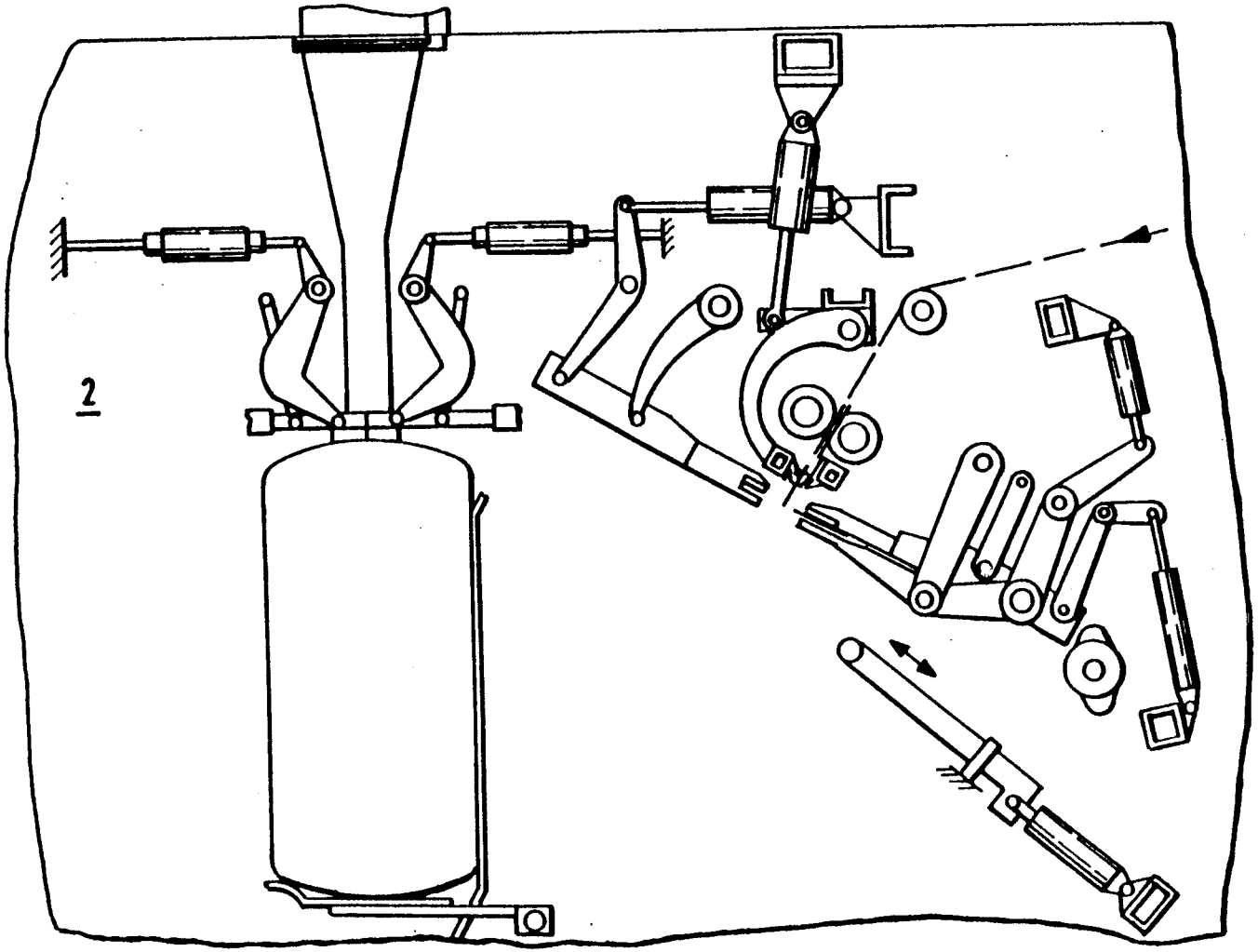
FIG. 10 shows the device in accordance with FIG. 9 in the case of which a bag is rocked into the filling station.
Figure 11:
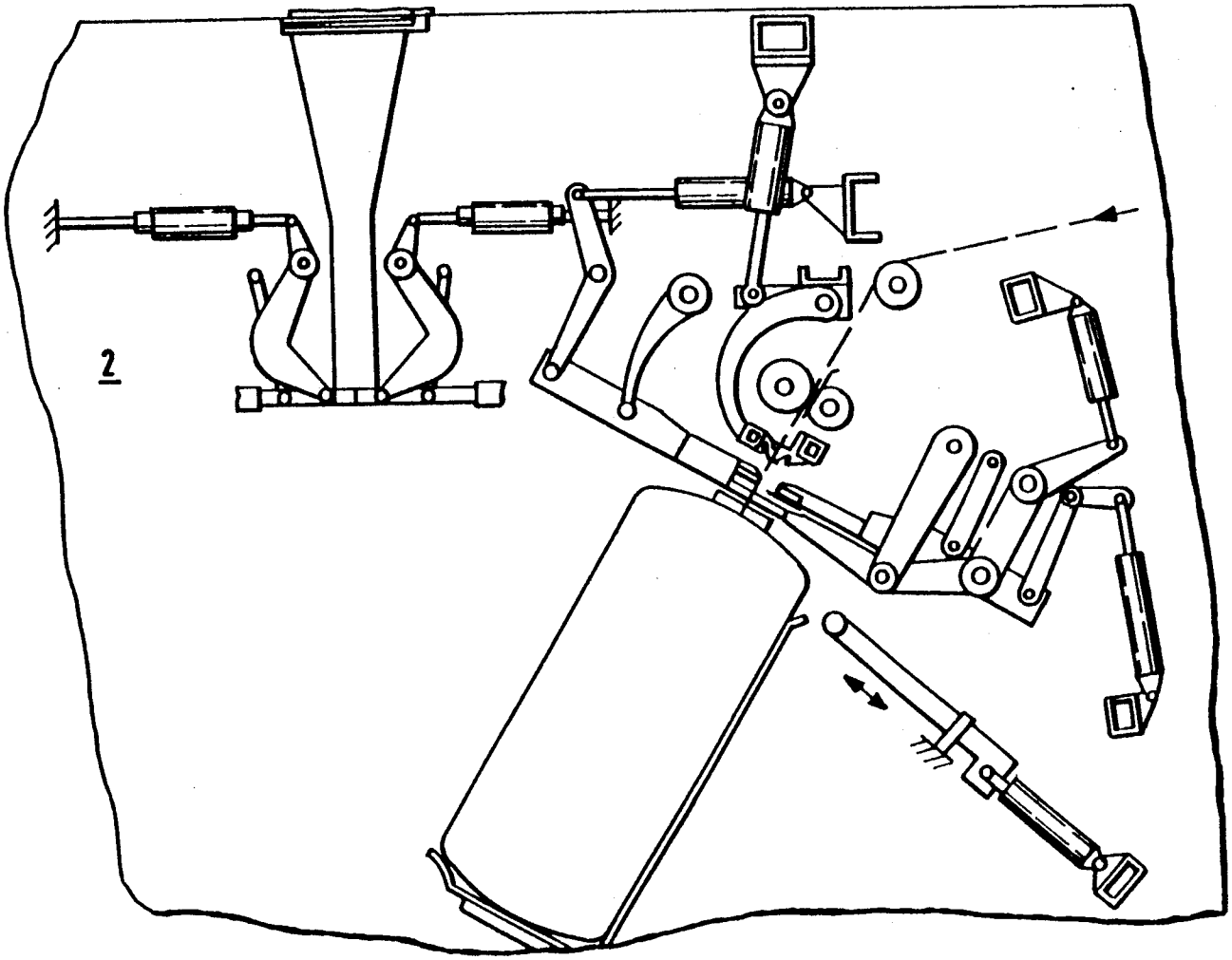
FIG. 11 shows the device in accordance with FIGS. 9 and 10 in a condition in which the filled bag has been rocked back into the welding station for the production of the head weld.

FIGS. 9 through 11 show a further working embodiment, in which the possibility of pivoting the welding device and of vertically moving the device bearing the bag is dispensed with so that both the device rocking the bag and also the arms bearing the welding devices are directly bearinged on the frame walls.

The levers bearing and rocking the welding jaws are directly bearinged on the lateral frame walls. In addition the transverse girder carrying the welding jaws is provided with two parallel and spaced welding jaws 111 and 112. Into the space left between these two welding jaws a cutting knife 113 may be moved, which is mounted on the upper welding jaw 114, which is borne by a transverse girder 45. The transverse girder 36, which in accordance with the working embodiment of FIGS. 1 through 3 was in the form of a knife carrier or girder, bears a welding jaw 115 for cooperation with the welding jaw 112.

The upper welding jaws 111 and 114 form the bottom weld of the next following bag on the respectively free end of the tubular foil web, the preceding bag simultaneously being severed underneath the transverse weld by the severing knife 113.

FIG. 9 shows a bag which has just been formed and which has been gripped by the gripper 154 on both sides of its upper opening edge.

FIG. 10 shows the bag as rocked into the filling station where it is being filled.

FIG. 11 shows the bag after rocking back into the welding station during welding of the head seam closing the bag by the welding jaws 112 and 115.

I claim:

1. A method for manufacturing, filling and sealing a bag using a flat web of tubular foil which comprises providing a leading end of the web with a terminal transverse weld seam at a position in a welding station, severing a section of the web in the form of an open bag including said seam at one end thereof from the remainder of the web, filling the bag, drawing the open end of the bag taut, and closing the bag by means of a further transverse weld, the method including after formation of the terminal transverse weld by welding jaws at the welding station, the steps of feeding the tubular web through the welding jaws by a length suitable for forming a bag, gripping the web laterally by a pair of grippers and, at a higher level than the grippers, severing the bag from the remainder of the web by a transverse cut, thereby forming the bag with an open end, holding the bag by the grippers on two sides adjacent the open end, conveying the bag with the grippers into a filling station, moving the grippers towards each other to open the bag, filling the bag at the filling station, moving the grippers apart to pull the open end of the bag taut after filling, using at least the grippers to return the bag into said position in the welding station and in the welding station sealing the open end of the bag by said further transverse weld.

2. The method as claimed in claim 1, wherein the bag is returned into the welding station by being pivoted from an upright filling position into an oblique position.

3. The method as claimed in claim 2, wherein in the oblique position, after formation of said further weld, the closed bag is released from the grippers and slides onto a conveying device for removal.

4. An apparatus for manufacturing, filling and sealing a bag using a flat web of tubular foil comprising a welding station having a welding device for providing a leading end of the web with a terminal transverse weld, and a knife for severing a section of the web in the form of an open bag including said seam at one end thereof from the remainder of the web, a filling station spaced from the welding station and including a filling spout for filling the bag, a pair of grippers for engaging the bag in the filling station adjacent the open end thereof and on opposite sides thereof after formation of said transverse weld and severing of the bag, the grippers each comprising cooperating jaws adapted to be moved towards and away from each other, and drive means for moving the grippers from the welding station to the filling station for transferring the bag to the filling station, for moving the respective grippers towards each other in the filling station to enable filling of the bag and them away from each other to draw the open end of the bag taut, for returning the grippers with the filled bag to the welding station for closing the open top of the bag by means of the welding device and then for moving the respective jaws of the grippers away from each other in the welding station to release the bag.

5. Apparatus as claimed in claim 4, including means for moving the welding device between two positions for forming the terminal weld and the further weld respectively.

6. Apparatus as claimed in claim 5, wherein the welding device is pivotally mounted in a machine frame and is provided with a drive for moving the welding device between the two positions.

7. Apparatus as claimed in claim 4, including support device for the bag pivotally mounted in a machine frame to pivot the bag between an upright filling position in the filling station and an oblique position for forming the further weld at the welding station.

8. Apparatus as claimed in claim 7, wherein the support device comprises lateral vertically extending support arms forming a lateral support grid and further support arms movable in relation to the lateral arms for supporting the bottom of the bag.

9. Apparatus as claimed in claim 8, wherein the further support arms extend through longitudinal gaps between the lateral support arms, and are vertically movable relative thereto to accommodate different bag lengths.

10. Apparatus as claimed in claim 7, wherein the grippers and the support device are disposed in a frame and the apparatus includes means for raising and lowering the frame in relation to weld device to produce the respective welds.

11. Apparatus as claimed in claim 4, wherein the weld device includes an upper weld means for producing the terminal weld and a lower weld means for producing the further weld.

12. Apparatus as claimed in claim 7, wherein the further support arms are provided with a jogging drive.

13. Apparatus as claimed in claim 7, wherein the further support arms have a pivoting and jogging drive and are journaled in a carrying part for vertical movement in relation to the lateral support arms.

14. Apparatus as claimed in claim 13, including a drive screw for vertically moving the carrying part.

15. Apparatus as claimed in claim 7, wherein the grippers and the support device are mounted in a frame which is pivoted on a machine frame part and the drive means includes a rocking drive for pivoting the frame.

16. Apparatus as claimed in claim 4, which includes an intermitedly drive pair of feed rolls for advancing the web.

17. Apparatus as claimed in claim 16, including a pair of gripping jaws between the feed rolls and the welding device.

18. Apparatus as claimed in claim 4, wherein the welding device comprises a pair of welding jaws secured to respective levers pivotally mounted by means of pairs of parallel links on a frame which is itself pivotally mounted in a machine frame.

19. Apparatus as claimed in claim 18, wherein one of said welding jaws is provided with a groove and the other welding jaw is provided with a cutting knife for receipt in said groove.

* * * * *